US008324820B2

(12) United States Patent
Janning

(10) Patent No.: US 8,324,820 B2
(45) Date of Patent: Dec. 4, 2012

(54) CAPACITOR SHUNTED LED LIGHT STRING

(75) Inventor: John L. Janning, Bellbrook, OH (US)

(73) Assignee: JLJ, Inc., Bellbrook, OH (US)

( * ) Notice: Subject to any disclaimer, the term of this patent is extended or adjusted under 35 U.S.C. 154(b) by 0 days.

(21) Appl. No.: 12/334,100

(22) Filed: Dec. 12, 2008

(65) Prior Publication Data

US 2009/0091263 A1 Apr. 9, 2009

Related U.S. Application Data

(60) Provisional application No. 61/200,104, filed on Nov. 24, 2008.

(51) Int. Cl.
*H05B 39/00* (2006.01)
*H05B 41/00* (2006.01)

(52) U.S. Cl. ..... 315/185 R; 315/185 S

(58) Field of Classification Search ..... 315/121–123, 315/125, 127, 185 R, 185 S, 186, 192, 200 A; 362/568, 612, 565, 630, 555, 800
See application file for complete search history.

(56) References Cited

U.S. PATENT DOCUMENTS

| | | | | |
|---|---|---|---|---|
| 1,024,495 | A | 4/1912 | Booth | |
| 1,809,673 | A | 6/1931 | Butler | |
| 1,868,689 | A | 7/1932 | Brander | |
| 2,072,337 | A | 3/1937 | Kamm | |
| 2,760,120 | A | 8/1956 | Fisherman | |
| 3,345,482 | A | 10/1967 | Lou | |
| 3,532,931 | A * | 10/1970 | Harnden, Jr. et al. | 431/359 |
| 3,535,585 | A | 10/1970 | Barnum | |
| 3,639,805 | A | 2/1972 | Muench et al. | |
| 3,912,966 | A | 10/1975 | Harnden, Jr. | |
| 4,450,382 | A | 5/1984 | Sawka et al. | |
| 4,631,650 | A | 12/1986 | Ahroni | |
| 4,653,084 | A | 3/1987 | Ahuja | |
| 4,667,481 | A * | 5/1987 | Watanabe et al. | 62/235 |
| 4,675,575 | A | 6/1987 | Smith et al. | |
| 4,682,079 | A | 7/1987 | Sanders et al. | |
| 4,727,449 | A | 2/1988 | Fleck | |
| 5,006,724 | A | 4/1991 | Liu | |
| 5,111,058 | A | 5/1992 | Martin | |
| 5,237,528 | A * | 8/1993 | Sunami et al. | 365/149 |
| 5,243,510 | A | 9/1993 | Chenny, II | |
| RE34,717 | E | 9/1994 | Sanders et al. | |
| 5,379,214 | A | 1/1995 | Arbuckle et al. | |
| 5,453,664 | A | 9/1995 | Harris | |
| 5,539,317 | A | 7/1996 | Janning | |
| 5,550,319 | A | 8/1996 | Segan et al. | |
| 5,777,868 | A | 7/1998 | Gibboney, Jr. | |
| 5,886,423 | A * | 3/1999 | Gershen et al. | 307/36 |
| 6,084,357 | A | 7/2000 | Janning | |
| 6,283,797 | B1 | 9/2001 | Wu | |
| 6,323,597 | B1 | 11/2001 | Janning | |
| 6,344,716 | B1 | 2/2002 | Gibboney, Jr. | |
| 6,373,199 | B1 | 4/2002 | Erhardt et al. | |
| 6,518,707 | B2 * | 2/2003 | Gershen et al. | 315/129 |

(Continued)

*Primary Examiner* — Minh D A
(74) *Attorney, Agent, or Firm* — Dickstein Shapiro LLP

(57) ABSTRACT

A series connected LED light string using capacitors as shunts. The shunts are implemented by inserting a capacitor—for example a low breakdown voltage chip capacitor—in every light socket, or internally within each LED. The capacitive shunt continues current in the light string in the event an LED fails by opening electrically—the capacitor shorts out, thus, keeping the string of lights illuminated. The shunt capacitor across the LED also helps filter the pulsating DC voltage to the bulbs and reduces annoying flicker.

2 Claims, 3 Drawing Sheets

U.S. PATENT DOCUMENTS

| | | | | |
|---|---|---|---|---|
| 6,580,182 | B2 | 6/2003 | Janning | |
| 6,672,738 | B1 | 1/2004 | Lewis et al. | |
| 6,765,313 | B2 | 7/2004 | Janning | |
| 7,166,968 | B2 * | 1/2007 | Janning | 315/185 R |
| 7,178,961 | B2 | 2/2007 | Janning | |
| 7,245,085 | B2 * | 7/2007 | Villarin | 315/188 |
| 7,279,809 | B2 | 10/2007 | Janning | |
| 7,851,981 | B2 * | 12/2010 | Altamura | 313/9 |
| 2002/0043943 | A1 * | 4/2002 | Menzer et al. | 315/291 |
| 2008/0157688 | A1 | 7/2008 | Gibboney | |
| 2009/0289561 | A1 * | 11/2009 | Chen | 315/185 S |

* cited by examiner

CAPACITOR SHUNTED LED LIGHT STRING

This application claims the benefit of U.S. provisional application Ser. No. 61/200,104, filed Nov. 24, 2008.

BACKGROUND OF THE INVENTION

In widespread use today are Christmas light strings formed of Light Emitting Diodes (LED's) connected in electrical series connection operating on rectified AC. While it has been widely thought that LED's would last for thousands and thousands of hours, the reality is that some may fail under certain conditions.

Since the LED's are connected in electrical series connection, the entire light string fails when one light emitting diode fails by opening the electrical connection. One possible solution to this is to provide a shunt across the LED terminals in case of failure. Several types of shunts are possible. One possible shunt is to wind a few turns of oxide coated wire around the two leads of the LED—much like the internal shunt inside an incandescent miniature light bulb. Another possibility is to shunt the LED's in the string with a Zener diode such as disclosed and claimed in U.S. Pat. No. 6,580,182 for incandescent miniature lights.

SUMMARY OF THE INVENTION

The present invention is a new and novel approach to shunting LED's in a series connected light string using capacitors as shunts.

By inserting a tiny capacitor—for example a low breakdown voltage chip capacitor—in every light socket and electrically connecting it to the light emitting diode electrodes in that socket, a shunt is implemented. The capacitive shunt continues current in the light string in the event of an LED failing by opening electrically—the capacitor shorts out, thus, keeping the string of lights illuminated. The shunt capacitor across the light emitting diode also helps filter the pulsating DC voltage to the bulbs and reduces annoying flicker.

BRIEF DESCRIPTION OF THE DRAWINGS

Other features and advantages of the present invention will become more apparent from the detailed description of exemplary embodiments provided below with reference to the accompanying drawings in which.

DETAILED DESCRIPTION OF THE INVENTION

Figure 1:
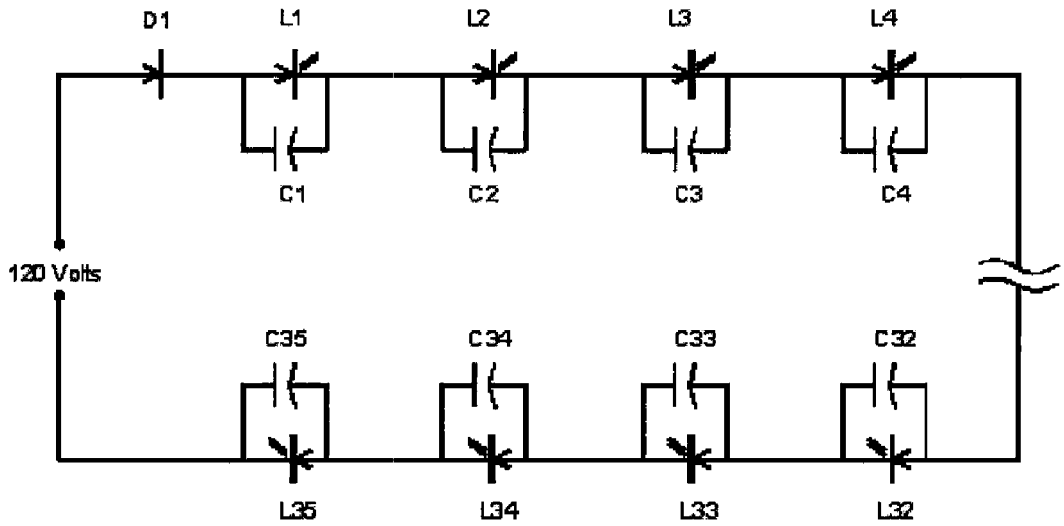
FIG. 1 is an electrical schematic diagram which diagrammatically illustrates the construction of a novel light string in accordance with the teachings of the present invention.

With reference to the schematic diagram in FIG. 1, an illustrative series-circuit light string constructed in accordance with the teachings of the present invention is typically connectable to a source of 110/120 volts of AC operating potential 100 which is normally available in typical households, and commercial and industrial establishments. In series with the 120 volt AC operating source is an optional rectifier diode 110 to permit only pulsating DC voltage to be applied to said light string. This single rectifier diode 110 provides half-wave rectification for the bulbs connected in the series string.

Such a series-connected light string is provided with a first socket having a first LED L1 operatively plugged or otherwise positioned therein. The adjacent terminal of the first socket is electrically and series-connected to the adjacent terminal of the second socket having a second LED L2 operatively plugged therein, and so on, until each of the LED's in the entire string are finally operatively connected in an electrical series-circuit arrangement to the rectified AC power supply through rectifier diode 110 providing half-wave pulsating DC to the light string. In a preferred embodiment of the invention, the light string consists of 35 LED's provided in respective sockets.

Operatively connected in electrical parallel across the electrical terminals of the first socket, hence the electrical terminals of first electric bulb L1, is a first capacitor shunt C1. Likewise, operatively connected in electrical parallel across the electrical terminals of the second socket, hence second LED L2, is a second capacitor shunt C2, and so on, until each of the remaining sockets, and hence each of remaining LED's L3 through L35 of the series has a corresponding one of capacitor shunts C3 through C35 operatively connected in parallel thereacross.

For practical purposes, it is preferred that all of capacitor shunts C51 through C85 are of identical construction and comprise a capacitor of approximately 10 microfarad or smaller to keep cost down. This invention is not limited to any particular capacitor value. The value of the shunt capacitor does not have an effect on the brightness of the remaining bulbs in the string when a bulb fails by opening the series-wired circuit. This is because upon bulb failure, the capacitor is subjected to the full voltage applied and quickly shorts out, thus, continuing current in the series-wired light string.

Since the capacitor shunt shorts out when an operative LED is missing in the corresponding socket, the peak voltage appearing thereacross is preferably approximately the same or slightly higher than the peak voltage rating of that supplied to the corresponding LED, when in the socket. Accordingly, when a particular LED is missing from its socket, the voltage across that particular socket remains substantially unchanged and, accordingly, the voltage across each remaining LED in the string remain substantially unchanged, hence the light output from each remaining LED remains substantially unchanged. The shunt capacitor across the light emitting diode not only keeps current flowing in the string, but also helps filter the pulsating DC voltage to the LED's and reduces annoying flicker.

Figure 2:
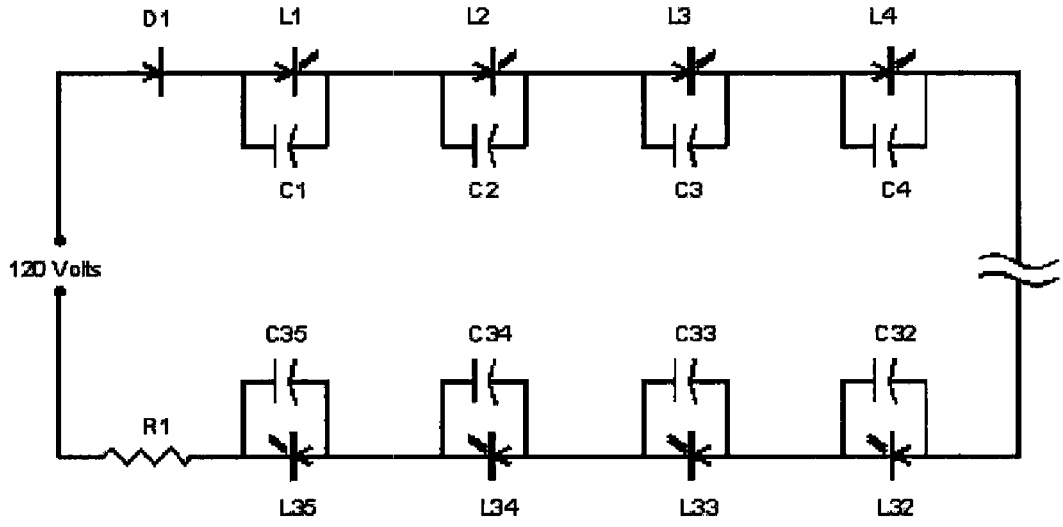
FIG. 2 diagrammatically illustrates a second preferred embodiment with a current limiting resistor R1 in the series wired string of LEDs.

FIG. 2 diagrammatically illustrates a second preferred embodiment with an optional current limiting resistor R1 in the series wired string of LED's. The rectifier diode D1 and the resistor R1 are optional in FIG. 2, and the rectifier diode D1 is optional in FIG. 1.

In either the circuit of FIG. 1 or FIG. 2, with or without the rectifier diode and with or without the current limiting resistor R1, with a capacitor shunt connected across each LED socket in a 35-light series wired string, when a LED burns out, falls out or is deliberately taken out of its respective socket, or otherwise becomes inoperative for any reason, the associated capacitor shunt C1-C35 continues to maintain the uninterrupted conduction of current through the remaining series-connected LED's in the circuit. More than one LED can likewise either burn out, fall out or be deliberately taken out of its respective socket, or otherwise become inoperative for any reason and still the remaining LED's continue to remain illuminated at substantially the same brightness as before. In fact, many of the LED's in the circuit can be removed from their respective sockets before an unpleasing visual effect is detected in the illumination of the remaining LED's.

In other words, in the example shown in FIGS. 1 and 2, when an LED is removed from its respective socket for any reason, the associated capacitor shorts out and thereby causes the entire remaining LED's in the string to continue to be illuminated. As a result, the illumination of the remaining LED's remain substantially unchanged.

Another type of LED light string contains light emitting diodes counter connected in parallel. In this type of light string shown in FIG. 3, power is supplied directly from the 120 volt AC source. An advantage in this type of light string is that higher voltage capacitors, (for example, 200 volt units), can be used as actual shunts where current can continue to flow in the series-wired circuit even though a bulb burns out; is loose in the socket or missing altogether. However, in this case, it is necessary to use higher capacitance capacitors as the capacitor does not short out and current flows due to the capacitive reactance. It is best to use values of one microfarad or more.

Figure 3:
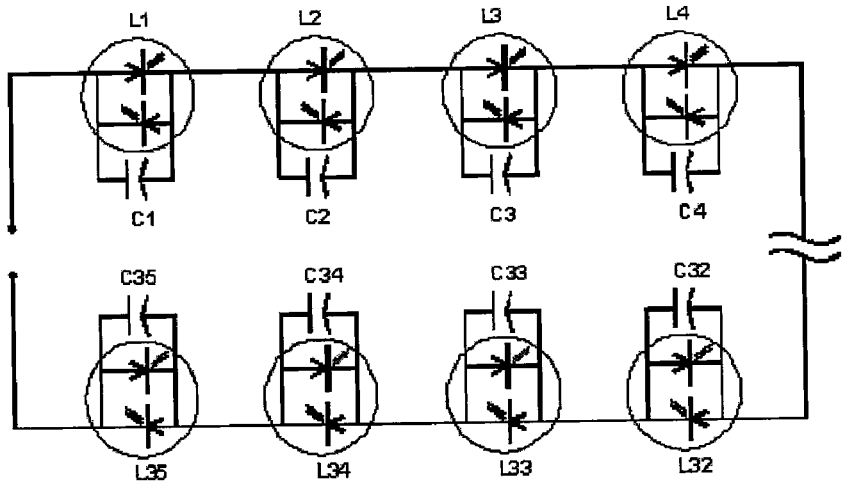
FIG. 3 is an electrical schematic diagram which diagrammatically illustrates another type of LED light string containing light emitting diodes counter connected in parallel.
Figure 4:
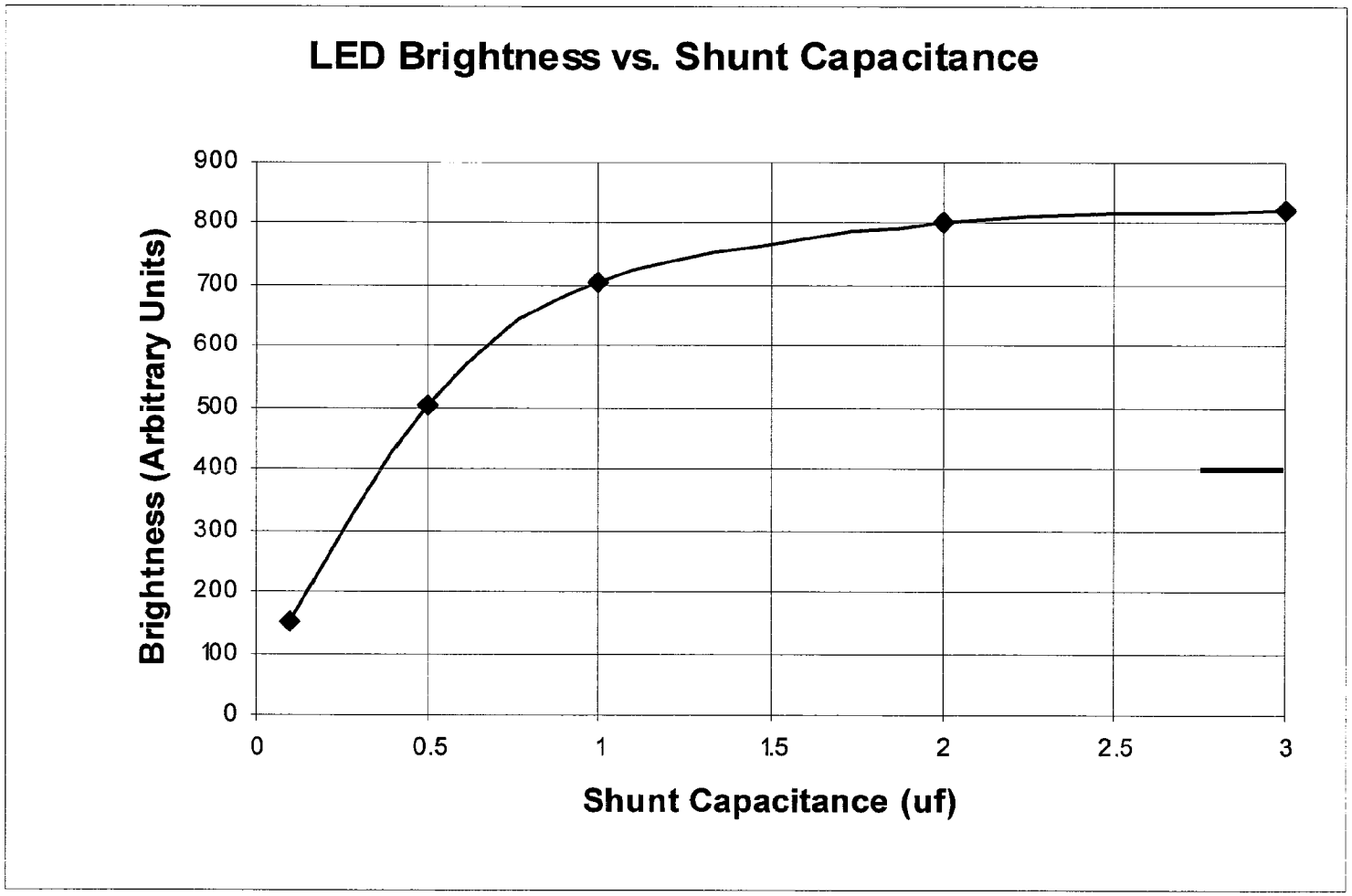
FIG. 4 is a chart showing the effect of brightness change on a typical white light string, where LED's are counter connected in parallel as in FIG. 3, versus the shunt capacitor used across the bulbs in the string.

FIG. 4 is a chart showing the effect of brightness change on a typical white light string, where LED's are counter connected in parallel as in FIG. 3, versus the shunt capacitor used across the bulbs in the string. The chart is normalized such that if a 3 microfarad capacitor is used as a shunt, and one bulb opens electrically, the brightness drops from 100% to 99.5% as can be seen from the chart. If two bulbs open, the string brightness drops to approximately 92.5%. However, if a 1 microfarad capacitor is used as a shunt in all of the sockets and one bulb opens, the brightness of the remaining bulbs in the string drops to approximately 85.2% of the original brightness. If a second bulb opens, the brightness drops to approximately 61% of its original value.

Figure 5:
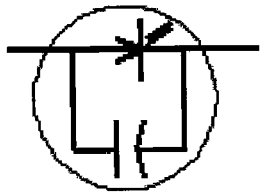
FIG. 5 shows a capacitor connected across the terminals of a light emitting diode inside its own housing.
Figure 6:
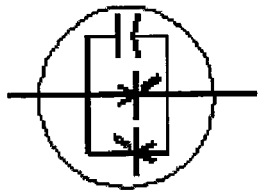
FIG. 6 shows a capacitor connected across two LED's counter connected in parallel inside its own module.

Instead of placing the capacitor inside each socket, the capacitor could be placed inside the LED module itself. FIG. 5 shows a capacitor connected across the terminals of a light emitting diode inside its own housing. Likewise, FIG. 6 shows a capacitor connected across two LED's counter connected in parallel inside its own module. This permits the use of lower voltage capacitors, thus reducing the price of each capacitor.

Thus, in a string with replaceable LED's, a 6-10 volt capacitor could be used as a shunt instead of a 200 volt unit. Of course, 6-10 volt capacitors could also be placed in sockets in a light string. However, in a string with replaceable, LED's that socket would be shorted forever when low voltage capacitors are used. The capacitance value would not matter for shunt purposes as it would short out when the LED opened. Another possibility is to use a breakdown device where a dielectric between two conductors breaks down to a shorted condition. Such an LED would have its own built-in electrical shunt.

The use of capacitors as shunts is not the same as using a Zener diode (as in U.S. Pat. No. 6,580,182, as there is no breakdown region where voltage can be regulated. The use of capacitors as shunts is possible because of the capacitive reactance using alternating current.

While the brightness variation numbers appear to be quite large, one needs to keep in mind that brightness is not a linear function. A drop of 90% in brightness actually appears as half brightness.

Although the invention has been described in detail in connection with the exemplary embodiments, it should be understood that the invention is not limited to the above disclosed embodiments. Rather, the invention can be modified to incorporate any number of variations, alternations, substitutions, or equivalent arrangements not heretofore described, but which are commensurate with the spirit and scope of the invention. Accordingly, the invention is not limited by the foregoing description or drawings, but is only limited by the scope of the appended claims.

What is claimed is:

1. A series wired light string, comprising:

a plurality light emitting diodes (LEDs), connected to a source of 120 volts AC standard house current, each of the LEDs being contained in a respective housing; and a plurality of low breakdown voltage capacitor shunts, each shunt being electrically connected in parallel across an LED and disposed within the respective housing of the LED, the capacitor shunt being subjected to full line voltage upon failure of the LED with which it is connected in parallel, causing the capacitor to breakdown and short out, thereby maintaining the current passing through the series wired light string in the event that the LED is inoperative, such that the remaining LED's in the light string remain illuminated at substantially unchanged brightness, wherein each of said shunts comprises a capacitor with a breakdown voltage of approximately ten volts or more.

2. A series wired light string as recited in claim 1, further comprising a rectifier in series with said source of AC voltage to convert said AC voltage into pulsating DC voltage for powering said light string.

* * * * *